US006119432A

United States Patent [19]

Niemann

[11] Patent Number: 6,119,432

[45] Date of Patent: Sep. 19, 2000

[54] CONCRETE FORM WALL BUILDING SYSTEM

[76] Inventor: Michael H. Niemann, 7200 Forest Ct., Windsor Heights, Iowa 50311

[21] Appl. No.: 09/389,607

[22] Filed: Sep. 3, 1999

[51] Int. Cl.[7] ..... E04C 2/00

[52] U.S. Cl. ..... 52/797.1; 52/437; 52/438; 52/429; 52/687

[58] Field of Search ..... 52/783.15, 783.18, 52/83.19, 309.16, 309.17, 425, 431, 437, 438, 442, 439, 429

[56] References Cited

U.S. PATENT DOCUMENTS

| | | | |
|---|---|---|---|
| 1,451,144 | 4/1923 | Decker | 52/437 |
| 1,760,817 | 5/1930 | Creamer | 52/783.19 |
| 3,788,020 | 1/1974 | Gregori | 52/309 |
| 4,190,999 | 3/1980 | Hampton | 52/687 |
| 4,924,641 | 5/1990 | Gibbar | 52/204 |
| 5,465,542 | 11/1995 | Terry | 52/309.7 |
| 5,469,674 | 11/1995 | Morello | 52/86 |
| 5,930,958 | 8/1999 | Stanley | 52/98 |

*Primary Examiner*—Carl D. Friedman
*Assistant Examiner*—Kevin McDermott
*Attorney, Agent, or Firm*—G. Brian Pingel

[57] ABSTRACT

An insulated concrete form wall building system includes a pair of spaced apart elongated expanded polystyrene sidewalls, each having opposed inner surfaces that are formed with longitudinally spaced apart vertically oriented ribs that terminate in substantially flat surfaces to abut against one another to serve as a concrete wall form. The ribs define channels for receiving concrete poured therein to form a composite polystyrene and concrete wall structure.

9 Claims, 5 Drawing Sheets

Fig. 7
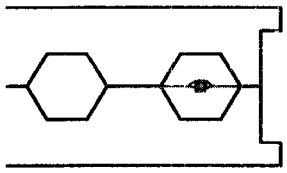
Fig. 4
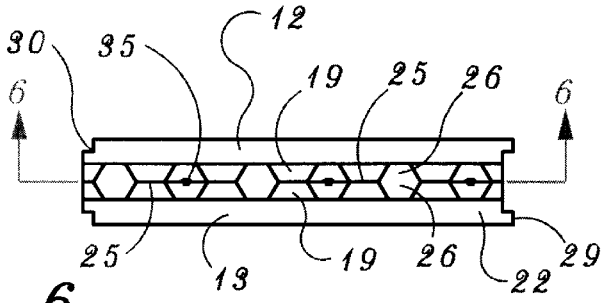
Fig. 6
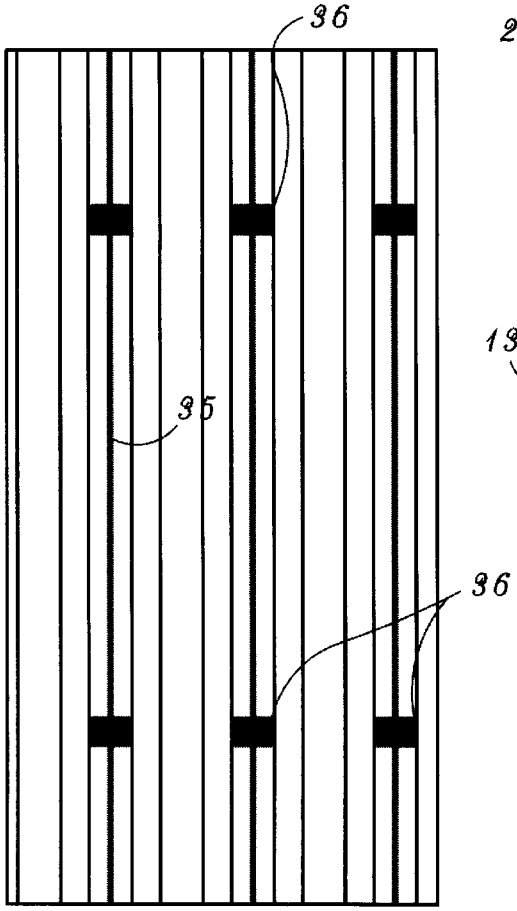
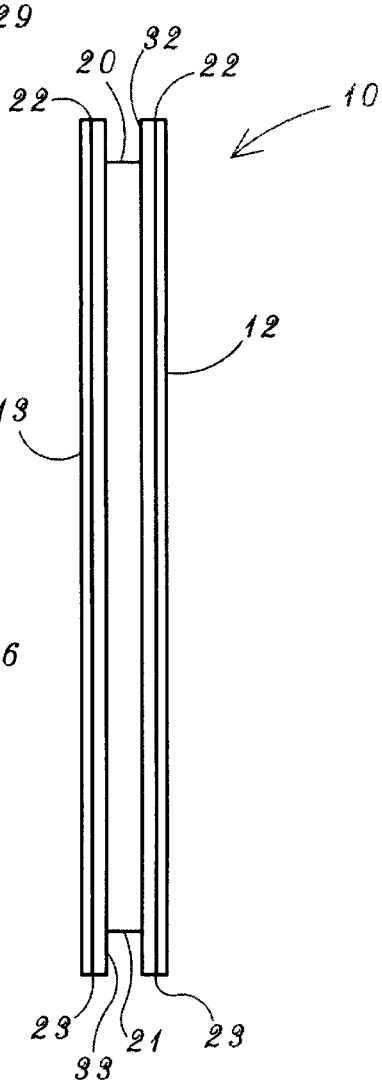
Fig. 5

CONCRETE FORM WALL BUILDING SYSTEM

BACKGROUND OF THE INVENTION

1. Field of the Invention

The present invention relates in general to an insulated concrete form wall building system and more particularly to a form provided by expanded polystyrene sidewalls between which channels are formed and into which concrete in slurry form is poured and thereby become a part of the permanent wall structure.

2. Description of the Prior Art

The use of insulated concrete form wall building systems has been known for several decades as a means of eliminating the use of metal or wooden forms for the onsite construction of concrete walls for buildings. Although the use of metal or wooden forms provides a reliable means for making wall structures, such use suffers from the disadvantage that the forms are cumbersome and awkward to use and they must be removed after the concrete is sufficiently hard to allow their removal so that they do not end up forming a part of the wall structure. Such activity is labor intensive and particularly results in a substantial amount of on site labor in positioning the forms for pouring of the concrete.

Currently, competitive insulated concrete form building systems employ the use of expanded polystyrene material and fall into two basic categories, block style and sheet style. Block style systems use a molded expanded polystyrene building block system which is stacked in a building block configuration to form the concrete walls. The block style systems are easy to use, but they require a substantial amount of on site labor to assemble. The blocks typically incorporate internal clips or brackets that are designed to strengthen the joints therebetween. One of the principal disadvantages of the block style systems is that they do not readily accommodate openings for windows or doors, which limits their practical use primarily to separate wall systems or simple structures such as garages.

The sheets style systems use two molded expanded polystyrene sheets, one on each side of the form. Typically, the sheets are held apart by system of clips or brackets that have to be assembled on the job site and is cumbersome and labor intensive. Various methods of sealing the joints between the sheet systems have been devised but again they are all labor intensive. None of the sheet systems incorporate features for easily placing windows or doors, again resulting in costly on site labor. Another major disadvantage that both competitive systems suffer from is that they do not support the concrete without additional bracing (external forms or shoring) in order to prevent the concrete from breaking through the forms when it is poured.

Although competitive insulated concrete form systems have many shortcomings, they are gaining acceptance in the industry because of the energy savings and comfort they bring to the building structure. The use of competitive systems have been sold on their energy saving merits alone. Also, building codes are requiring insulation on the basement and foundation walls. Thus, insulated concrete form systems have been experiencing particularly increased acceptance as systems for building basements and foundation walls even though they do not provide any savings, from a construction labor standpoint, over conventional construction methods. However, their acceptance by large contractors or developers is still fairly limited.

The present invention provides an insulated concrete form building system that significantly decreases the amount of on site labor required and provides for a system in which windows and doors are readily accommodated.

SUMMARY OF THE INVENTION

The present invention provides an insulated concrete form wall building system having spaced apart elongated expanded polystyrene sidewalls, each having opposed inner surfaces that are formed with longitudinally spaced apart vertically oriented ribs that terminate in substantially flat surfaces to abut against one another to serve as a concrete wall form.

The spaced apart ribs define channels for receiving concrete poured therein. Preferably, the polystyrene sidewalls are formed by cutting a single sheet of expanded polystyrene into two generally equal portions. Preferably, the top and bottom edges of the sidewall ribs have top and bottom ends that are spaced apart from the sidewall edges to provide upper and lower concrete receiving areas between the sidewalls that are in communication with the channels between the ribs. To form windows and doorways, the ribs of the sidewalls have opposed interrupted portions for receiving spacer members that are placed between the sidewalls, which spacer members are in the shape of the desired window or doorway.

The foregoing and other advantages of the present invention will appear from the following description. In the description, reference is made to the accompanying drawings, which form a part of hereof, and in which they are shown by illustration, and not of limitation, a specific form in which the invention may be embodied. Such embodiment does not represent the full scope of the invention, but rather the invention may be employed in a variety of embodiments, and reference is made to the claims herein for interpreting the breadth of the invention.

BRIEF DESCRIPTION OF THE DRAWINGS

FIG. 4 is a plan view of the embodiment of FIG. 1;

FIG. 5 is an end view in elevation of the embodiment of FIG. 1;

FIG. 6 is a cross-sectional view taken along the line 6—6 of FIG. 4;

FIG. 7 is an enlarged fragmentary view of one end of the embodiment shown in FIG. 4;

DETAILED DESCRIPTION OF THE PREFERRED EMBODIMENT

The present invention provides an improved insulated concrete form wall building system that can be advantageously utilized in the construction industry as a quick and efficient means for providing insulated foundations, basements and above grade concrete walls in a manner that eliminates a substantial amount of on site construction labor and dramatically reduces on site construction and completion times. The system of the present invention offers greater versatility than that available through currently used block or sheet based insulated concrete form systems, and is suitable and applicable to interior and exterior sub grade, above grade and multi-story applications.

Figure 1:
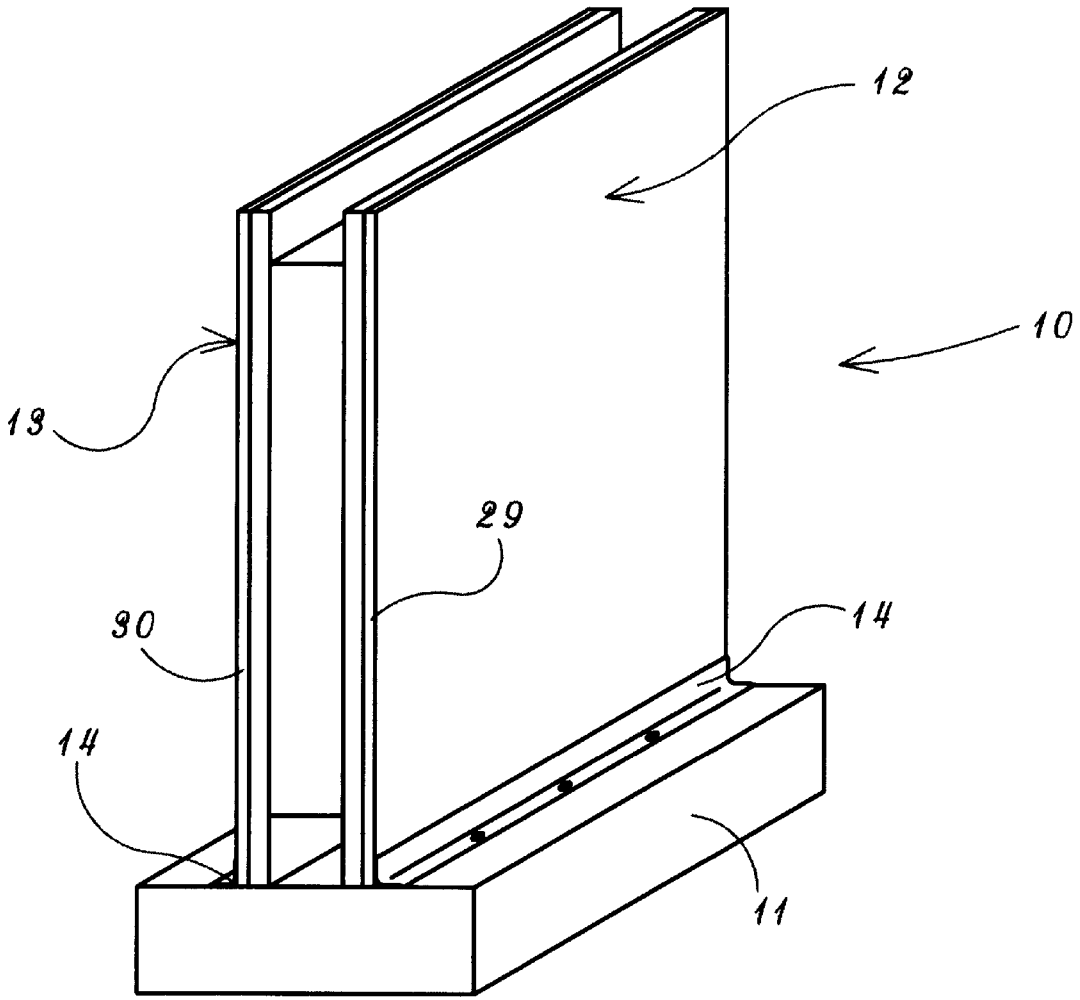
FIG. 1 is a side perspective view of a preferred embodiment of an insulated concrete form wall building system of the present invention.

Referring now to FIG. 1 a preferred embodiment of an insulated concrete form wall building system is shown generally at 10. It should be understood by those skilled in the art that the embodiment shown is only one section of an entire system, with each of the sections being identical in construction except for those sections that may have doors or windows. The system 10 is set on top of a standard type foundation footing 11 and includes a pair of elongated expanded polystyrene sidewalls 12 and 13. Spaced apart angle irons 14 are secured to the footing 11 at the base of each of the sidewalls 12 and 13 to hold them in place with respect to the footing 11.

Figure 2:
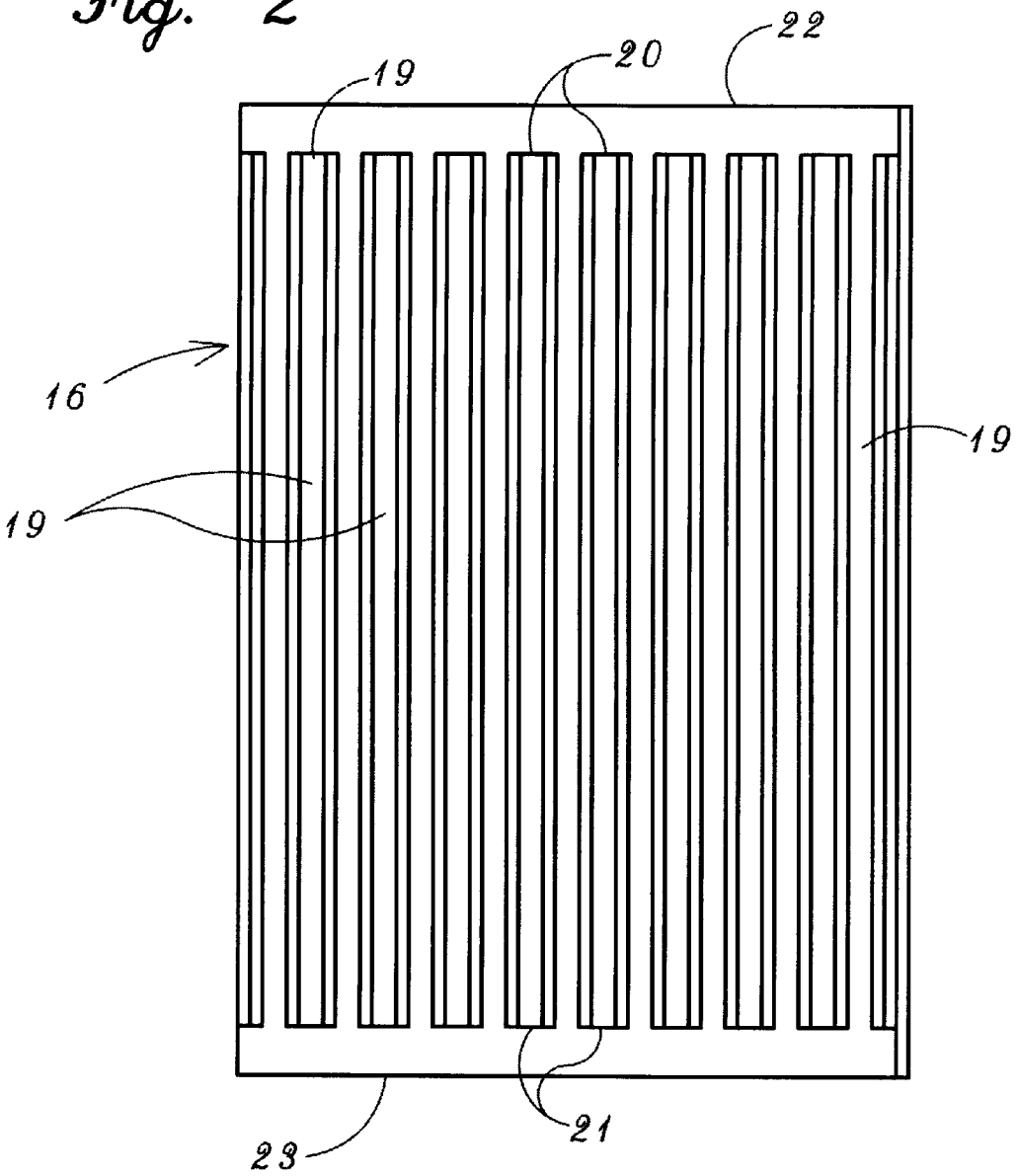
FIG. 2 is a side view in elevation of a sidewall that is used to form a portion of the embodiment of FIG. 1, with the other sidewall of the embodiment being a mirror image of that shown.
Figure 3:
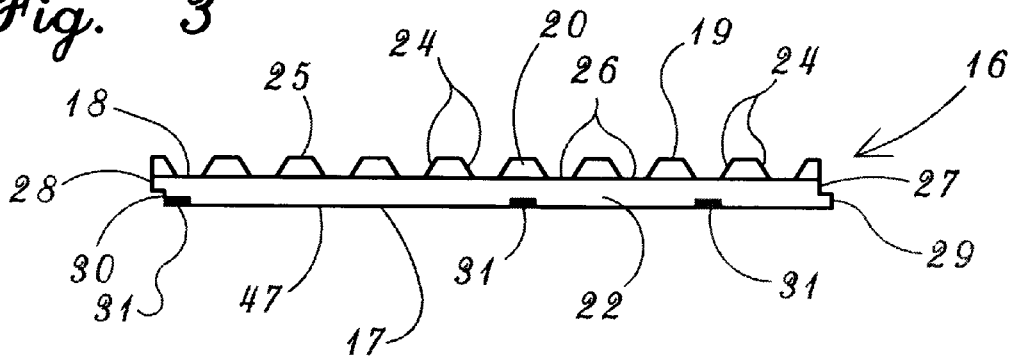
FIG. 3 is a plan view of the sidewall of FIG. 2.

As seen in FIGS. 2 and 3, a sidewall 16 that may serve as either of the sidewalls 12 or 13 is shown. The sidewall 16 has an outer surface 17 (indicated only in FIG. 3) and an inner surface 18 provided with longitudinally spaced apart vertically oriented ribs 19 that project outwardly from the inner surface 18. As seen in FIG. 2, the ribs 19 have top and bottom ends 20 and 21 respectively that are spaced from top and bottom edges 22 and 23 respectively of the sidewall 16. As best shown by FIG. 3, each of the ribs 19 is formed with two inclined side portions 24 that terminate in an outer flat surface 25 to provide channels 26 between the ribs 19 that are in a shape that is a mirror image to that of the ribs 19 so that two sidewalls 16 can be cut from a single sheet of expanded polystyrene by a hot wire. Preferably, side edges 27 and 28 of the sidewall 16 are formed to intermate with an adjacent sidewall 16. The side edge 27 includes a narrow ledge portion 29 and the side edge 28 includes a recessed portion 30 of generally equal size to the ledge portion 29. It is also preferable that the sidewall outer surface 17 includes a plurality of vertically aligned spaced apart recessed furring strips 31 that may be used for attaching finishing materials to the sidewall 16 once an insulated concrete wall structure is completed.

Referring now to FIG. 4, the sidewalls 12 and 13 are positioned with respect to one another so that the flat surfaces 25 of their ribs 19 abut against one another. In such position, the channels 26 between the ribs 19 form an enclosure for receiving concrete that is in a hexagonal shape. Additionally, as shown only in FIG. 5, due to the rib tops 20 and bottoms 21 being spaced apart from the top and bottom sidewall edges 22 and 23 respectively, upper and lower concrete receiving areas 32 and 33 respectively are provided and are in communication with the channels 26 between the ribs 19.

Figure 8:
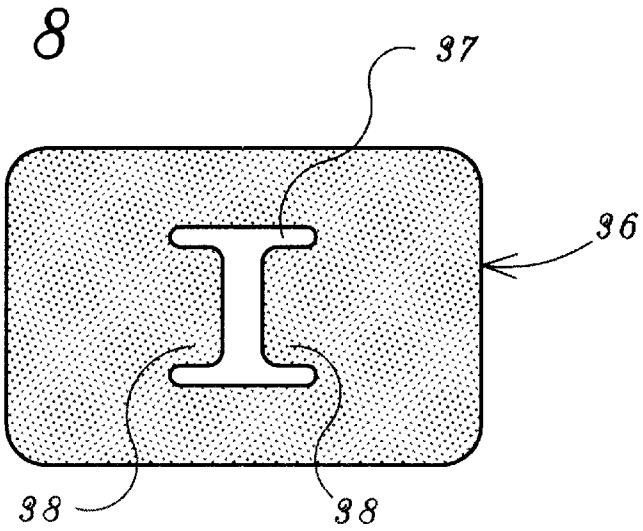
FIG. 8 is a side view in elevation of a rebar clip employed in the embodiment of FIG. 1.
Figure 9:
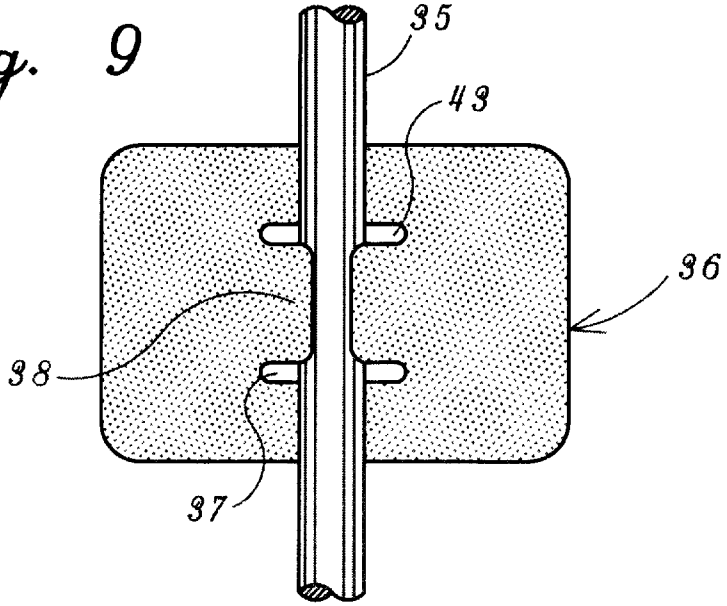
FIG. 9 is a side view in elevation of the rebar clip of FIG. 8 together with a segment of a rebar.
Figure 10:
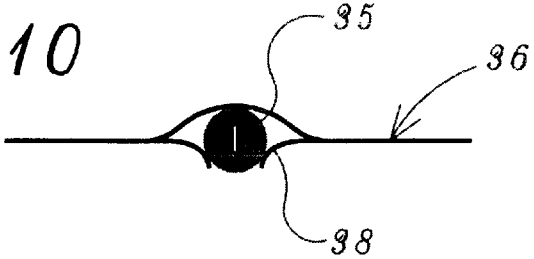
FIG. 10 is a plan view of the rebar clip and rebar of FIG. 9.

To strengthen the wall structure provided by the form system 10, rods of rebar 35 are positioned within the channels 26 (FIGS. 4, 6 and 7) by means of snap-on rebar centering clips 36, shown best in FIGS. 8, 9 and 10. The clips 36 are relatively thin and are formed in a rectangular shape with a center cutout portion 37 that provides two tabs 38 for fastening about the rebar 35 as shown in FIG. 9. Preferably, the clips 36 are formed of a semi-rigid plastic that is bendable for placement of the rebar 35 therein, but sufficiently strong to maintain the rebar in a proper position centered within the channels 26. By use of the clips 36, the rebar can be properly positioned within the channels 26 in a quick and efficient manner.

Figure 12:
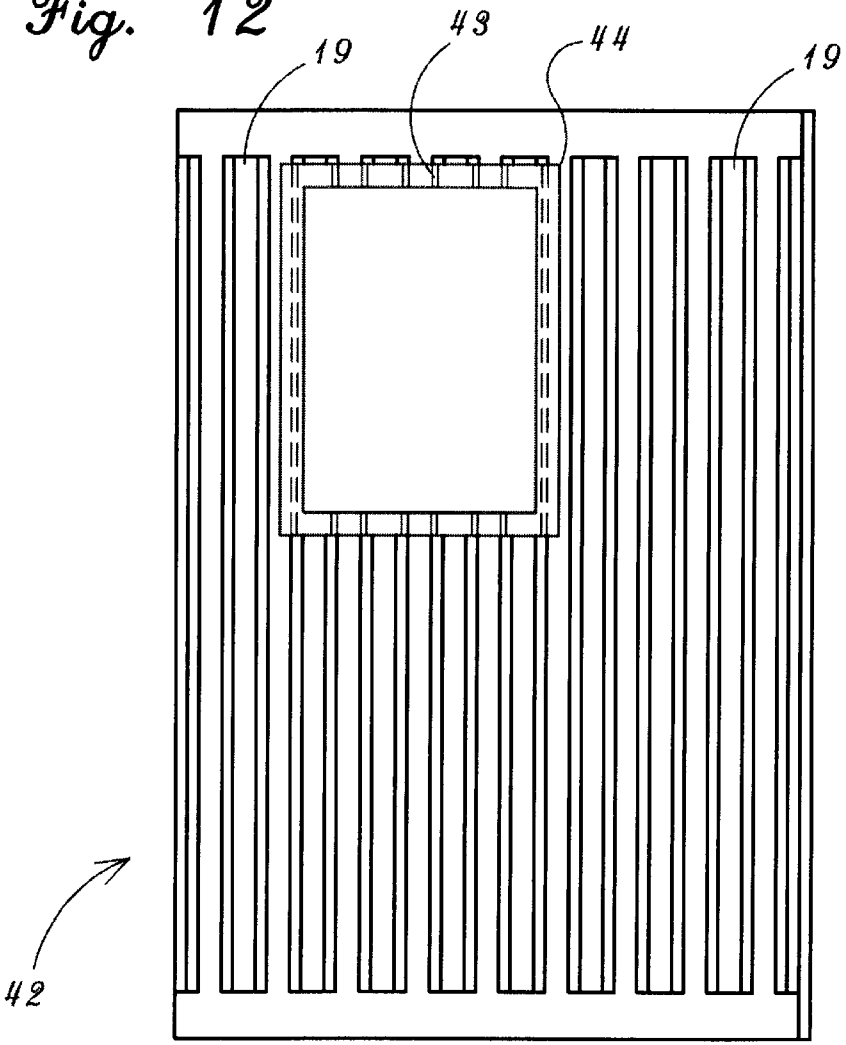
FIG. 12 is a side view in elevation of the sidewall of FIG. 11.
Figure 11:
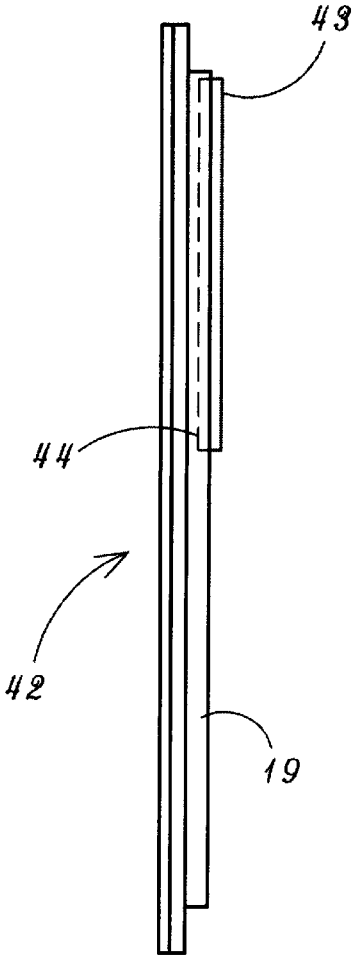
FIG. 11 is an end view in elevation of one of the sidewalls of the embodiment of FIG. 1, together with a window spacer that is attached thereto.

The use of the sidewalls 12 and 13 provides a strong and durable insulated wall structure that is formed without windows or doors. To provide windows or doors in structures produced by the form system 10, a sidewall 42, as shown in FIGS. 11 and 12, is utilized together with a spacer 43. The sidewall 42 differs from the sidewalls 12 and 13 by the fact that portions of the ribs 19 of the sidewall 42 are removed to provide a rectangularly shaped seat 44 corresponding to the shape of a window opening to be formed by the use of the sidewall 42. As an example, the sidewall 42 is designed to provide for a wall structure with a window. Once the portions of the ribs 19 have been removed to form the seat 44, the spacer 43 is installed in the sidewall 42 to prevent the flow of concrete within the removed portions of the ribs 19 and the channels 26 therebetween. When the wall structure is formed and cured, the opening formed by the spacer 43, which is preferably formed of polystyrene, may be cut out.

Thus, it can be seen that the form system 10 of the present invention can be advantageously used to quickly and efficiently form insulated walls. Preferably, a majority of the labor involved in forming the form system 10 can be completed off site. For example, the sidewalls 12 and 13 can readily be provided by the use of cutting a single sheet of polystyrene with the use of a hot wire in the particular configuration desired to include windows or doors as appropriate. The two sidewalls formed by such cutting are then glued together along with any window or door spacers as needed, and the location of the doors and windows are marked on the sidewalls. The fully assembled forms are then delivered to the job site for use. Although the invention has been described with respect to a preferred embodiment thereof, it is to be understood that it is not to be so limited, since changes and modifications can be made therein, which are within the full intended scope of the invention as defined by the appended claims.

What is claimed is:

1. An insulated concrete form building system comprising:

(a) a first elongated expanded polystyrene sidewall;

(b) a second elongated expanded polystyrene sidewall;

(c) said sidewalls each having an opposed inner surface integrally formed with longitudinally spaced apart vertically oriented ribs, the outer ends of which terminate in substantially flat surfaces and side surfaces which are generally planar and oriented so as to form an angle with said inner surface of said sidewall; and (d) whereby the outer ends of the ribs of said first sidewall abut against and are adhesively secured to the outer ends of the ribs of said second sidewall to provide a concrete wall form with a series of spaced apart channels of substantially uniform cross section between said ribs for receiving concrete poured therein; and (e) said sidewalls each having outer surfaces that are substantially planar.

2. A concrete form building system as recited in claim 1, wherein said first and second sidewalls have top and bottom edges and said ribs have top and bottom ends, with the top ends of said ribs being spaced apart from the top of said sidewalls and the bottom ends of said ribs are spaced apart from the bottom ends of said sidewalls to provide upper and lower concrete receiving areas that are in communication with the channels between said ribs.

3. A concrete form building system as recited in claim 2, wherein the ribs of each of said first and second sidewalls have opposed interrupted portions for forming windows or doors in said sidewalls.

4. A concrete form building system as recited in claim 3, wherein a spacer member is placed between said first and second sidewalls positioned within the interrupted portions of said ribs.

5. A concrete form building system as recited in claim 1, wherein said system further comprises elongated rebar positioned within said spaced apart channel.

6. A concrete form building system as recited in claim 5, wherein said system further includes a rebar clip attachable to each of said rebar, said clip having a winged configuration for properly positioning said rebar within said channels.

7. A concrete form building system as recited in claim 6, wherein said ribs of said sidewalls have inclined sides so that the inner portions of said ribs are wider than the outer portions thereof and the channels formed by said abutting ribs are substantially hexagonally shaped.

8. A concrete form building system as recited in claim 7, wherein the outer surface of at least one of said first and second sidewalls has spaced apart vertically oriented recesses and furring strips are positioned in said recesses.

9. A concrete form building system as recited in claim 8, wherein the other of said sidewalls also includes a plurality of vertically oriented spaced apart recesses and furring strips are positioned within said recesses.

* * * * *